US005670461A

United States Patent [19]

Schreiber et al.

[11] Patent Number: 5,670,461

[45] Date of Patent: Sep. 23, 1997

[54] HIGH TEMPERATURE LUBRICATING GREASE CONTAINING UREA COMPOUNDS

[75] Inventors: Hans Schreiber, Völklingen-Ludweiler; Peter Seigert, Lohmar; Herbert Konegen, Rösrath; Wolfgang Hildebrandt, Siegburg, all of Germany

[73] Assignee: GKN Automotive AG, Lohmar, Germany

[21] Appl. No.: 515,287

[22] Filed: Aug. 15, 1995

[30] Foreign Application Priority Data

Aug. 19, 1994 [DE] Germany ..... 44 29 507.3
Oct. 21, 1994 [DE] Germany ..... 44 37 742.8

[51] Int. Cl.[6] ..... C10M 123/02; C10M 169/06

[52] U.S. Cl. ..... 508/117; 508/127; 508/130

[58] Field of Search ..... 252/18, 25, 32.5, 252/51.5 R; 508/117, 127, 130

[56] References Cited

U.S. PATENT DOCUMENTS

| | | | |
|---|---|---|---|
| 3,933,656 | 1/1976 | Reick | 252/25 |
| 4,465,607 | 8/1984 | Cottell | 252/25 |
| 4,466,909 | 8/1984 | Stayner | 252/32.7 E |
| 4,759,859 | 7/1988 | Waynick | 252/25 |
| 4,902,435 | 2/1990 | Waynick | 252/51.5 R |
| 4,986,923 | 1/1991 | Waynick | 252/25 |
| 5,084,193 | 1/1992 | Waynick | 252/51.5 R |
| 5,160,645 | 11/1992 | Okaniwa et al. | 252/51.5 A |

FOREIGN PATENT DOCUMENTS

| | | |
|---|---|---|
| 1332936 | 8/1994 | Japan . |
| 2255103 | 10/1992 | United Kingdom . |

*Primary Examiner*—Margaret Medley
*Attorney, Agent, or Firm*—Nikaido Marmelstein Murray & Oram LLP

[57] ABSTRACT

Disclosed is a lubricating grease suitable for high temperature use, consisting essentially of 60 to 90% by weight of a base oil mixture comprising at least one mineral oil and at least one synthetic oil, 5 to 17% by weight of at least one urea compound as a thickener, wherein the at least one urea compound is a reaction product of at least one fatty amine and at least one isocyanate or at least one diisocyanate, 2 to 20% by weight of calcium complex grease, 1 to 4% by weight of molybdenum disulphide, 0.2 to 1% by weight of graphite powder, 0.2 to 1% by weight of polytetrafluoroethylene powder, 0.2 to 1% by weight of solid particles of at least one organo-molybdenum compound selected from a molybdenum dithiocarbamate and a molybdenum dithiophosphate, up to 2% by weight of a metal deactivator and up to 2% by weight of a corrosion inhibitor.

17 Claims, 4 Drawing Sheets

HIGH TEMPERATURE LUBRICATING GREASE CONTAINING UREA COMPOUNDS

Figure 1:
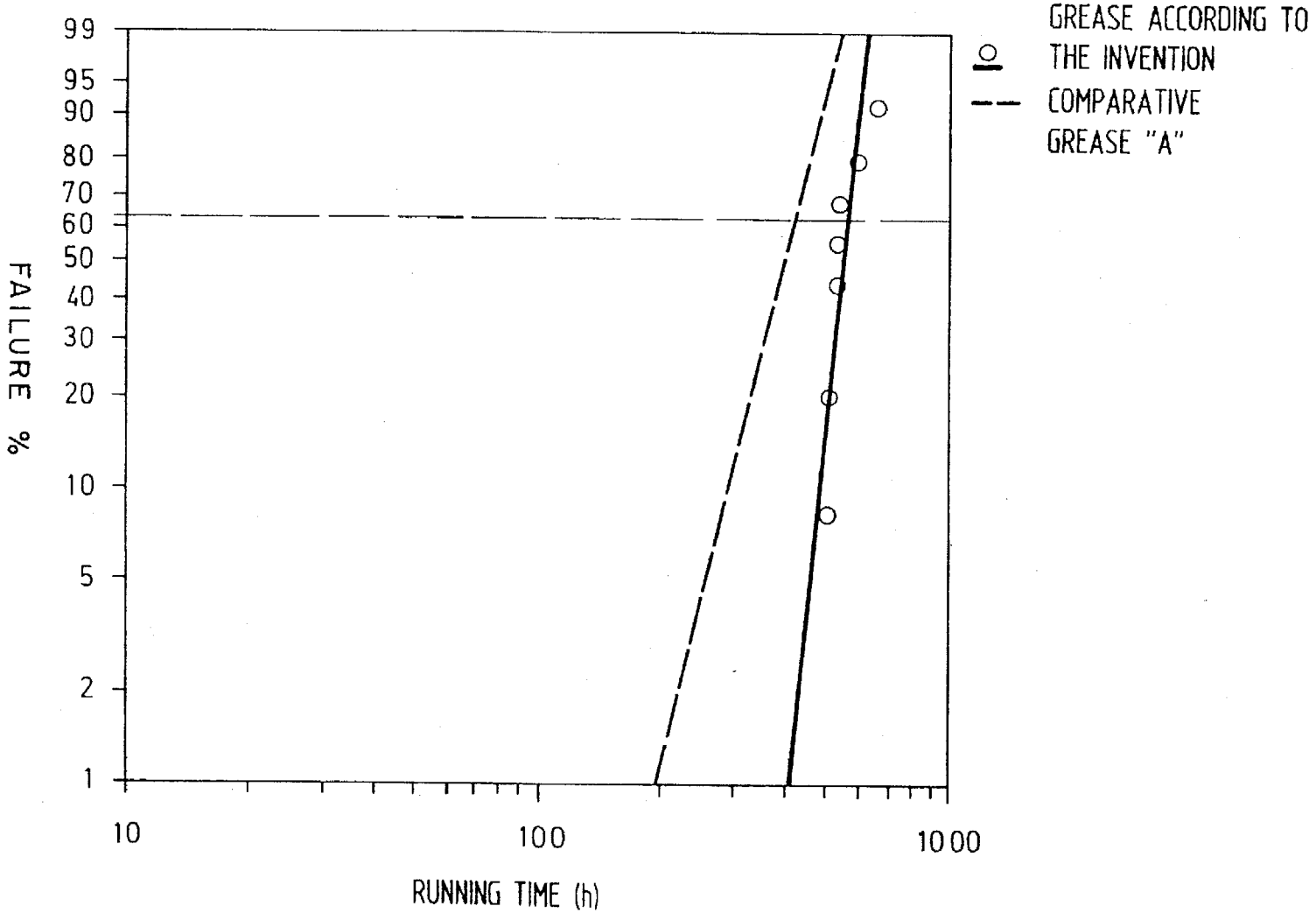

The present invention is concerned with a lubricating grease with a suitability for high temperature use based on mineral and/or synthetic oils or mixtures thereof, containing urea compounds as thickeners and molybdenum disulphide ($MoS_2$) as dispersed solid lubricating grease.

Lubricating greases based on mineral or synthetic oils which contain a thickening agent and molybdenum disulphide as dispersed solid lubricant are known. Thus, in GB 2,255,103A is disclosed a lubricating grease which contains, as thickener, urea and molybdenum disulphide, besides organo-metallic compounds of molybdenum and zinc. From JP-2-020597A is known a lubricating grease of corresponding composition which can also contain urea-urethane as thickener. These known lubricating greases are admittedly superior to the lithium greases with regard to their high temperature suitability but they still leave something to be desired with regard to the period of life, long-time endurance strength and greasing effectiveness. Furthermore, the production thereof is laborious and, therefore, expensive.

It is an object of the present invention to overcome the disadvantages of the known lubricating greases suitable for high temperature use and, in particular, to provide a lubricating grease, suitable for use with high temperature stressing in homokinetic joints, which grease can be produced with low expense and, in the various grease-relevant properties, achieves at least the properties of the known lubricating greases or exceeds them and, in the case of use as permanent solid grease in homokinetic joints, not only gives an improved period of life but also is readily compatible with the materials of which the bellows serving as seal consist and do not reduce the period of life thereof.

Thus, according to the present invention, there is provided a lubricating grease for high temperature use based on mineral and/or synthetic oils or mixtures thereof, containing urea compounds as thickeners and molybdenum disulphide ($MoS_2$) as dispersed solid lubricant which, as solid lubricants, additionally contains graphite, polytetrafluoroethylene and at least one organo-molybdenum compound, the content of the combination of molybdenum disulphide, graphite, polytetrafluoroethylene and organo-molybdenum compound being in the range of from 2 to 5% by weight, referred to the lubricating grease.

By urea compounds in the meaning of the present invention are to be understood reaction products of fatty amines and diisocyanates and/or homologues, isomers and polymers of diisocyanates.

By means of the multiple combination of solid lubricants according to the present invention, it is, surprisingly, possible to achieve not only a superior solid lubricant action and thus a correspondingly prolonged period of life of metallic frictional surfaces greased therewith but also substantially to reduce the amount of expensive solid lubricants used and thus, in all, to provide a superior product with substantially reduced production costs.

The combination of the four mentioned solid lubricants preferably contains about 40 to about 80% by weight of molybdenum disulphide, and graphite, polytetrafluoroethylene and organo-molybdenum compound forming in about equal parts the remaining 60 to 20% by weight. Variations in the amount of each component up to about 30% in comparison with the other components still do not impair the properties aimed for.

As organo-molybdenum compound, there is preferably used a solid material in the form of molybdenum dithiocarbamate, such as molybdenum oxysulphide dithiocarbamate. Molybdenum dithiophosphate or other organo-molybdenum compounds can also be used individually or as mixtures in the form of solid materials, especially together with a molybdenum dithiocarbamate.

Besides the quadruple combination of molybdenum disulphide, graphite, polytetrafluoroethylene and organo-molybdenum compound, the lubricating grease according to the present invention contains a polyurea or a derivative thereof as thickener. This polyurea preferably consists of the reaction product of primary fatty amine with a chain length of 8 to 22 carbon atoms and an isocyanate or several such fatty amines as mixture. These fatty amines are commercially available mixtures of fatty amines of differing chain lengths. As isocyanate components, there are preferably used the isocyanate which are readily soluble in the base oil and do not evolve any vapours at temperatures of up to 150° C. Examples of appropriate isocyanates include 1,3-diisocyanatobenzene, 2,4-diisocyanatotoluene and 4,4'-diisocyanatodiphenylmethane 4,4'-Diphenylmethane diisocyanate or a mixture of 4,4'-diphenylmethane diisocyanate with isomers and homologues is preferably used.

The polyurea is preferably present in an amount of from 5 to 17% by weight and more preferably of from 5 to 12% by weight, referred to the total lubricant grease.

As base oils, there can be used mineral oils and/or synthetic hydrocarbon oils. A naphthene base mineral oil in combination with a synthetic hydrocarbon oil in a ratio 1:3 to 1:6 is preferred. These should preferably have a viscosity of 100 to 150 centistokes at 40° C. As synthetic oils, there can be used, for example, poly-α-olefins with a viscosity of 1 to 40 and preferably of 3 to 15 centistokes at 100° C. Especially preferred is a content, referred to the total lubricating grease, of 60 to 70% by weight of naphthene base mineral oil and 10 to 20% by weight of synthetic oil. The fatty amine with the synthetic oil based on poly-α-olefins must be dissolved in the naphthene base mineral oil. This is necessary for the dispersion of the isocyanate components.

Besides the mentioned essential components, the lubricating grease according to the present invention also contains conventional oil-soluble additives. Thus, a sulphur-containing metal deactivator, which is preferably a mercapto compound, is preferably present, a mercaptothiadiazole being especially preferred as mercapto compound. In general, the amount of the metal deactivator is up to 2% by weight and preferably from 0.3 to 1.0% by weight. Furthermore, high pressure additives are preferably used.

A further additive which is preferably used is a corrosion inhibitor. The amount thereof can be up to 2% by weight and is preferably from 0.1 to 1% by weight. A combination of several corrosion inhibitors has also proved to be useful.

A further preferred component is a calcium complex grease which, when present, can be used in an amount of from 2 to 20% by weight and preferably of from 2 to 8% by weight.

A preferred lubricating grease according to the present invention contains 60 to 90% by weight of a mineral oil and synthetic oil mixture, 5 to 17% by weight of at least one urea compound, 2 to 20% by weight of calcium complex grease, 1 to 4% by weight of molybdenum disulphide, 0.2 to 1% by weight of graphite 0.2 to 1% by weight of polytetrafluoroethylene powder, 0.2 to 1% by weight of an organo-molybdenum compound, up to 2% by weight of a metal deactivator and up to 2% by weight of a corrosion inhibitor.

This preferred lubricating grease according to the present invention preferably contains 60 to 70% by weight of a naphthene base mineral oil and 10 to 20% by weight of synthetic oil based on poly-α-olefins as oil mixture.

A further preferred lubricating grease according to the present invention contains 60 to 70% by weight of a mineral oil, 10 to 20% by weight of synthetic oil based on poly-α-olefins, 5 to 12% by weight of at least one urea compound, 2 to 8% by weight of calcium complex grease, 1 to 3% by weight of molybdenum disulphide with a particle size of 0.2 to 10 μm, 0.2 to 0.6% by weight of graphite with an average particle size of 0.1 to 10 μm, 0.2 to 0.6% by weight of polytetrafluoroethylene powder with an average particle size of 1 to 20 μm, 0.2 to 0.6% by weight of molybdenum dithiocarbamate with an average particle size of 0.5 to 20 μm, 0.3 to 1% by weight of mercaptothiadiazole and 0.1 to 1% by weight of corrosion inhibitor.

An important advantage of the lubricating grease according to the present invention is to be seen in the fact that it can be produced without difficulty with the use of simple devices and thereby fulfils all possible requirements with regard to the protection of the environment. In particular, the product does not contain any free isocyanate and also no isocyanate vapours are evolved during the production thereof. This also makes possible the production in places where no technical means are available for extracting poisonous vapours possibly formed. An important part of this property is the low temperature of the order of 80° to 140° C. which suffices for the production of the grease according to the present invention.

The production of the lubricating grease according to the present invention is carried out by dissolving the fatty amine in a first part of the base oil or of the base oil mixture, the isocyanate is dispersed in a second part of the base oil, the two parts are then mixed at an elevated temperature and kept at 80° to 140° C. until the reaction of the fatty amine with the isocyanate has proceeded to completion and then the remaining components, i.e. the combination of solid lubricants and the oil-soluble additives, are admixed with the other components of the grease at a temperature of, at most, 90° C. For the production, it is preferred to proceed in such a manner that the two parts of the base oil which contain the components of the urea compound are brought to an elevated temperature in appropriate stirring devices, for example counter-running frame stirring devices or a planetary paddle mixer, and then mixed with one another. The temperature used for the pre-heating of the parts of the base oil to be mixed is generally 80° to 120° C.

In order to ensure that the isocyanate has completely reacted, the urea formation is preferably monitored, an IR spectrometer being well-suited for this purpose. If, after stirring for about two hours, the isocyanate has still not reacted completely, an appropriate amount of fatty amine can again be added.

The remaining components of the grease according to the present invention are added to the base grease obtained after formation of the urea compound, with the use of appropriate stirring and mixing devices. High pressure homogenisers and colloid mills, which bring about a good homogenisation, have proved to be useful.

The lubricating grease according to the present invention is preferably used as a solid grease filling for homokinetic joints and especially for homokinetic joints in which comparatively high temperatures arise in operation. The lubricating grease according to the present invention displays properties not only in the normal temperature range but also in the high temperature range which are at least equal to the best known high temperature lubricating greases and, in many respects, are better. Thus, the lubricant grease according to the present invention can be used for working temperatures of up to 150° C., which is not achieved by any commercially available lubricating greases.

Figure 2:
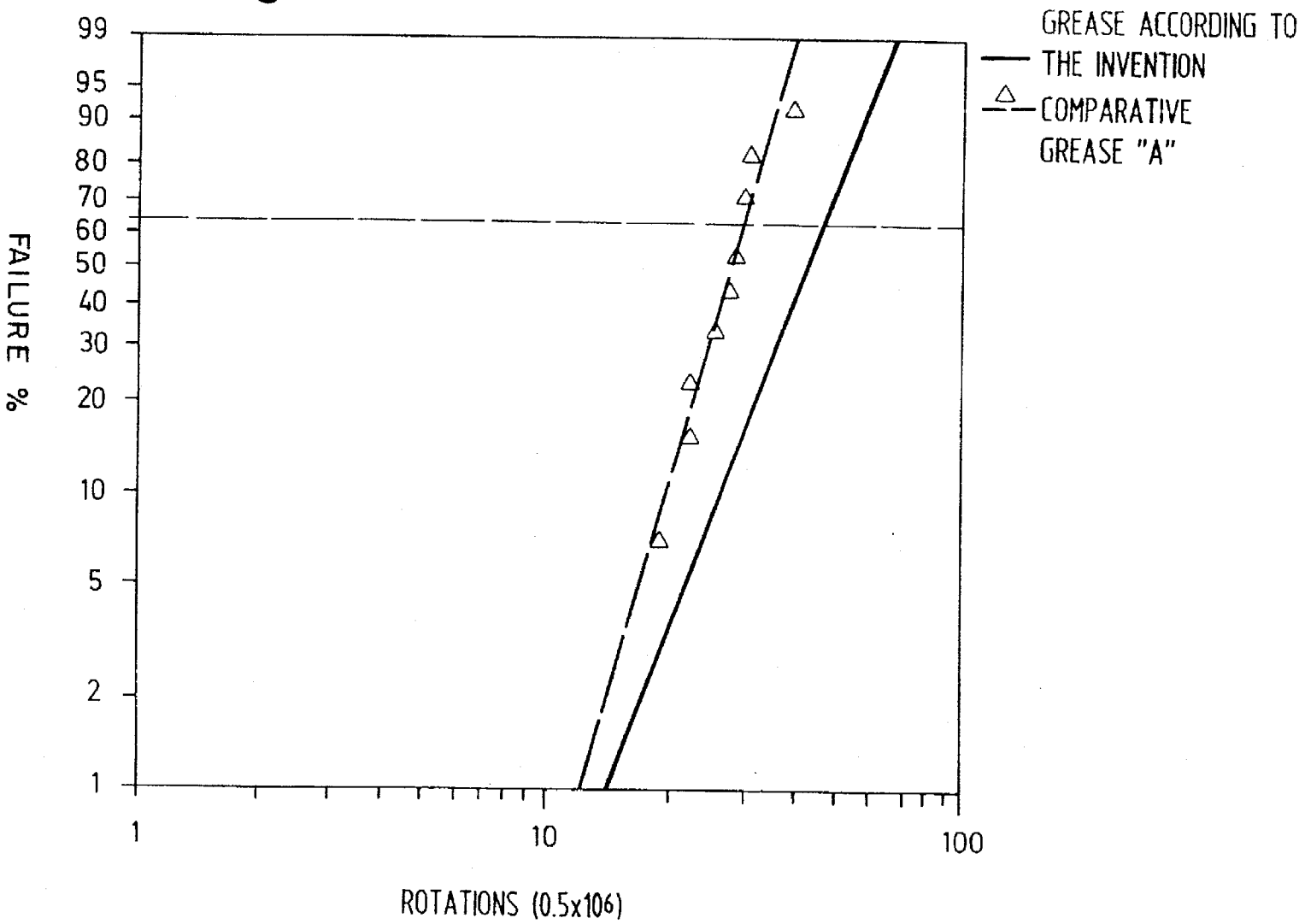
Figure 3:
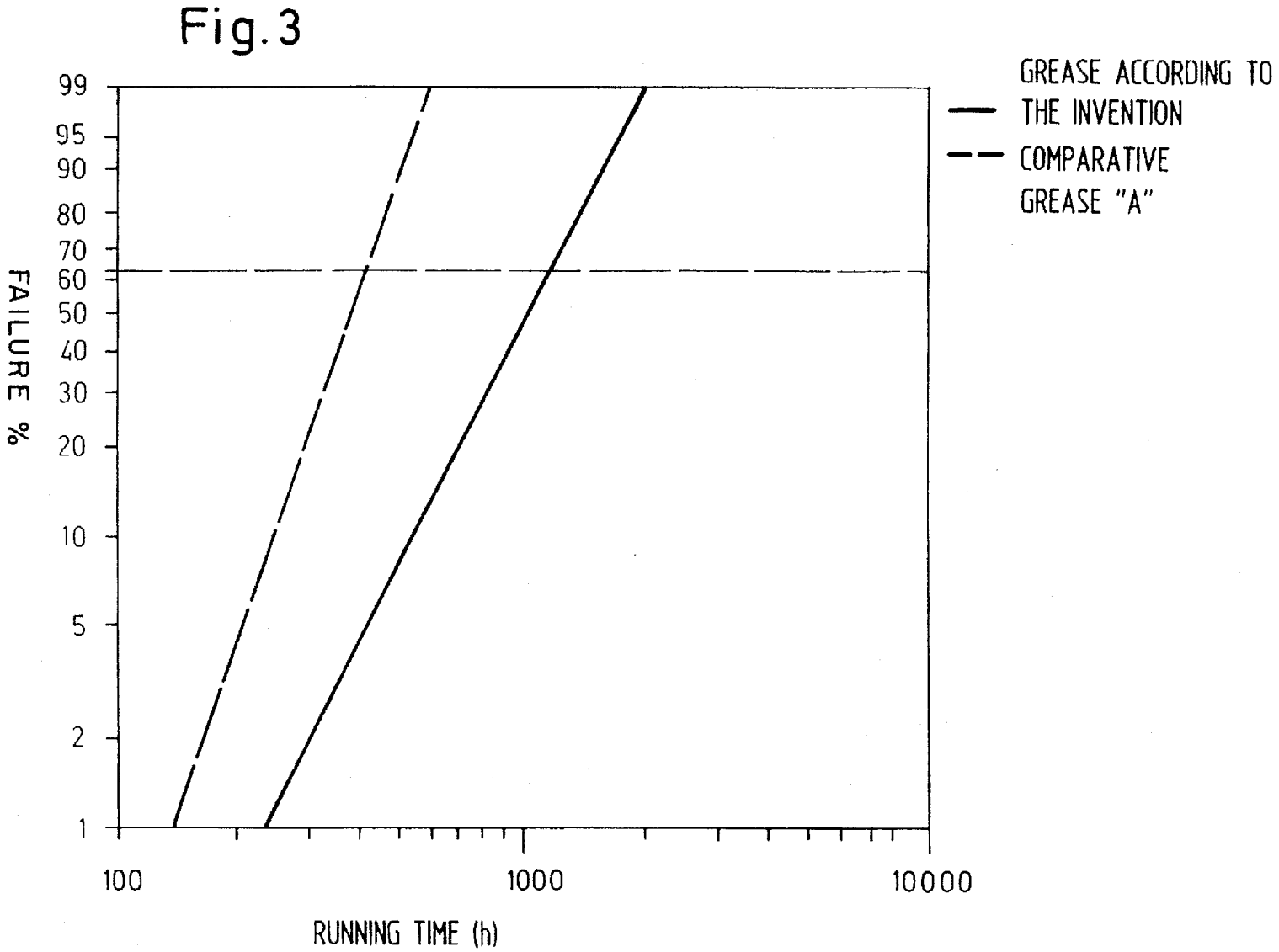
Figure 4:
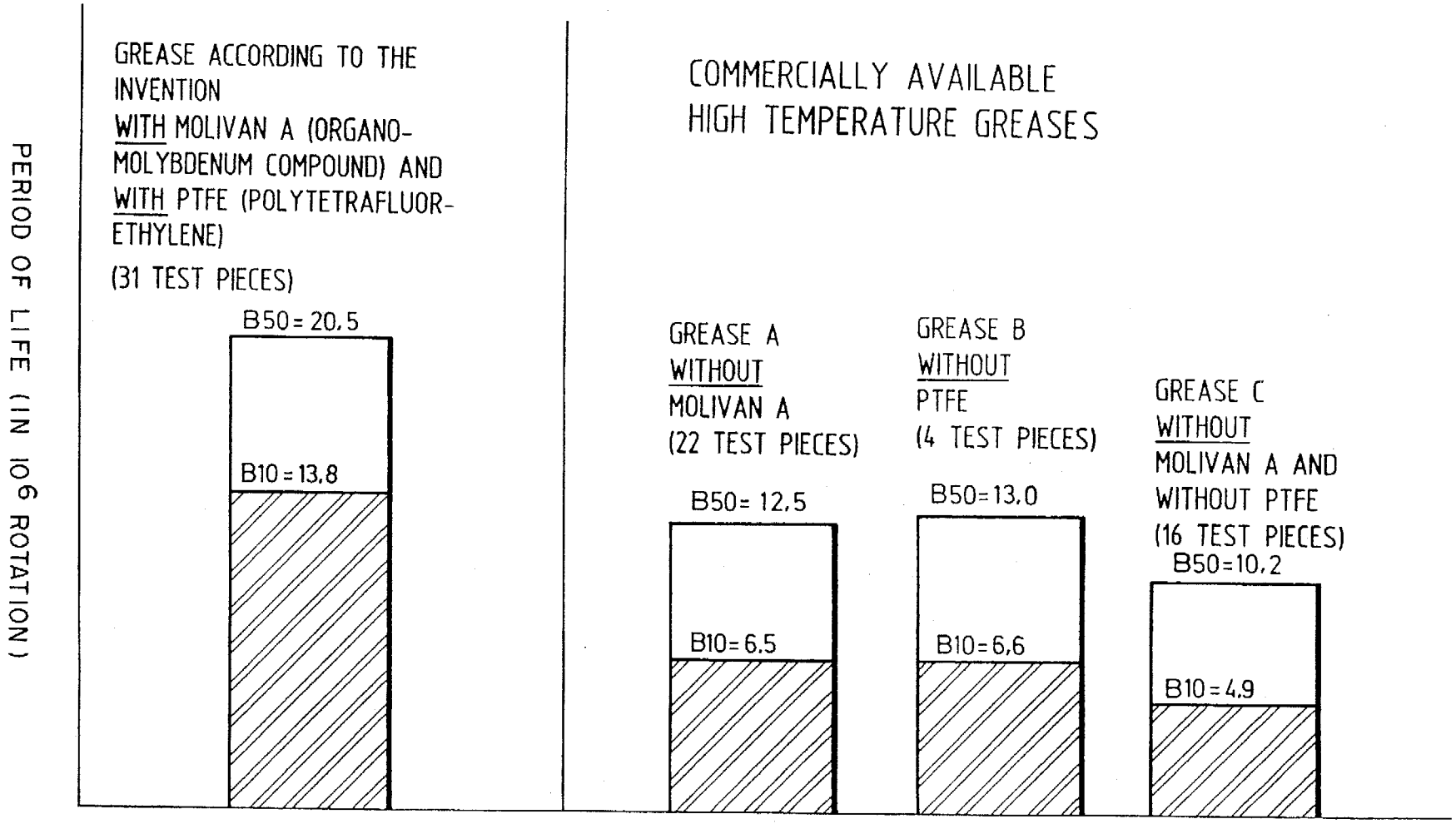

The properties of the lubricating greases according to the present invention are explained in more detail in the following Examples, with reference to the accompanying drawings. In the drawings:

FIG. 1 is a graphic representation of the normal temperature stability in hours for a grease according to the present invention and for a commercially available high temperature grease "A" in an 8-step test, FIG. 2 is a graphic representation of the normal temperature stability for the same grease according to the present invention and the high temperature grease "A" with the number of rotations achieved up to failure in a one-step test, FIG. 3 is a graphic representation of the high temperature stability in hours for the same grease according to the invention and the high temperature grease "A" with the running time up to failure in a block programme and FIG. 4 is a supplemented graphic representation of the normal temperature stability for the same grease according to the present invention and for three commercially available PU high temperature greases "A", "B" and "C" with different solid lubricant combinations up to failure in a one-step test according to FIG. 2.

In the normal temperature test the experiments gave an improvement of, on average, 70% in comparison with a commercially available grease known to be especially good, an increase in the period of life in a high temperature test of more than 100% with superior bellows comparability, not only in comparison with rubber but also in comparison with synthetic material bellows.

The following Examples further explain the present invention.

Preferred compositions of a grease according to the present invention.

A high temperature grease according to the present invention was produced in the following way. The total naphthene base oil with 65.4% of the parts by weight of the total grease was divided up into two parts, namely, a first portion with about 80% of the parts by weight and a second portion of about 20% of the parts by weight. In the first portion was dissolved hydrogenated tallow fatty amine with a proportion of 5% of the parts by weight of the total grease, with heating to 100° C.

A 1:1 suspension, referred to the weight, of 100% of the diisocyanate (4,4'-diphenylmethane diisocyanate), which accounted for 3.75% of the parts by weight of the final grease, with the synthetic oil based on poly-α-olefins was prepared and heated with stirring to 100° C.

The suspension was then added to the first portion of naphthene base oil with the dissolved fatty amine.

Because of the heat of reaction, the temperature of the mixture increased and, after reaching the maximum, was further heated to about 130° C. the temperature of 130° C. being maintained for at least 2 hours. The mixture was then tested for the presence of free diisocyanate and, if any was present, it was neutralised.

The base grease thus produced was cooled to a temperature of 80° C. Subsequently, the second portion of the naphthene base oil and of the synthetic oil based on poly-α-olefins not used in the reaction, as well as the calcium complex grease, were admixed and 2% of the parts by weight in the form of molybdenum disulphide of 5 μm particle size, 0.4% of the parts by weight in the form of graphite of 4 μm average particle size, 0.4% of the parts by weight in the form of polytetrafluoroethylene and 0.4% of the parts by weight in the form of molybdenum oxysulphide dithiocarbamate were mixed therewith. Furthermore, 0.6% of the parts by weight in the form of mercaptothiadiazole and 0.5% of the parts by weight in the form of a corrosion inhibitor were added thereto. The grease obtained was homogenised in a high pressure homogeniser, filtered and placed into containers. Instead of a high pressure homogeniser, a colloid mill with steel-interlocked rotor stator has prover to be useful. For the filtration, there was used a self-cleaning edge filter with a slit width of 100 μ.

The lubricating grease obtained has the following properties:

drop point: 225° C. (IP 396)

unworked penetration:308 (DIN/ISO 2137)

worked penetration (60): 310 (DIN/ISO 2137)

penetration after 100,000 DH: 347 (DIN/ISO 2137)

DIN oil separation 160 hours/40° C.: 1.97% (DIN 51817)

flow pressure at 20° C.: 80 mbar (DIN 51805)

flow pressure at −35° C.: 600 mbar (DIN 51805).

Experiment 1

For the assessment of the efficiency of the grease formulation according to the present invention, there was carried out a working-life failure test on ball homokinetic joints of the constructional type VL of the constructional size 93 (L öhr & Bromkamp GmbH, Offenbach, Federal Republic of Germany) with a dynamic transmission ability of 314 Nm and ball races made before the hardening (Friedrich Schmelz: Gelenke und Geleukwellen: Berechnung, Gestaltung, Anwendung/F. Schmelz; H-Ch. Graf v. Seherr-Thoss; E. Aucktor; Berlin, Heidelberg; New York; London; Paris; Tokyo; Springer, 1988 (Konstruktionsbücher, Volume 36).

The test programme used was an 8-hour test with torques, rotational speeds, articulated angles and running time parts according to the following Table. The 8 programme steps were repeated up to the failure of the joints. During the experiment, the joints were air-cooled (rate of blowing on: 12 m/s) and as failure there was evaluated an exceeding of the joint outer temperature of 80° C.

TABLE 8-step test programme

| programme step | torque [Nm] | rotational speed [$min^{-1}$] | time (min) | articulated angle [o] |
|---|---|---|---|---|
| 1 | 0 | 750 | 1 | 10 + 2 |
| 2 | 314 | 750 | 28 | 10 + 2 |
| 3 | 0 | 1050 | 1 | 10 + 2 |
| 4 | 220 | 1050 | 75 | 10 + 2 |
| 5 | 0 | 500 | 1 | 10 + 2 |
| 6 | 471 | 500 | 6 | 10 + 2 |
| 7 | 0 | 300 | 1 | 10 + 2 |
| 8 | 628 | 300 | 1 | 10 + 2 |

In the carrying out of this experiment, 8 joints were tested with a lubricating grease according to the present invention and 16 joints with a high temperature grease "A" based on PU present in serial use. This grease consisted of a base oil, a urea compound, molybdenum disulphide, graphite and polytetrsfluoroethyleue. It did not contain any organo-molybdenum components. An evaluation of the working life individual values by means of Weibull distribution (VDA: Qualitätskontrolle in der Automobilindustrie: Zuverl ässigkeitssicherung bei Automobil herstellern und Lieferanten, Verfahren und Beispiele: Verband der Automobilindustrie e.V. (VDA), Westendstrasse 61, Frankfurt/Main, Federal Republic of Germany, 1976) gave a distinctly improved working life for the grease according to the present invention, recognisable by the higher B10 and B50 values. The results obtained are given in the following Table.

TABLE 1 of results

| | grease formulation according to the present invention | comparative grease |
|---|---|---|
| number of test pieces | 8 | 16 |
| B10 (hours) | 482 | 285 |
| B50 (hours) | 546 | 384 |

For the observed random sample, the B10 value hereby describes the determined working life in which 90% of the test pieces had still not failed. Analogously, the B50 value describes the determined working life in which 50% of the test pieces had still not failed.

In FIG. 1 of the accompanying drawings is illustrated the graphic evaluation of this experiment. It can be seen that the running time in the case of the use of the grease according to the present invention is considerably higher than in the case of the use of the comparative grease.

Experiment 2

For the assessment of the efficiency of the grease formulation according to the present invention, there was carried out a working life failure test on ball homokinetic joints of the constructional type VL of the constructional size 6020 (L öhr & Bromkamp GmbH, Offenbach, Federal Republic of Germany) with a dynamic transmission ability of 390 Nm and ball races made before the hardening (see Schmelz, v. supra).

The test programme was a one-step test with a torque of constant 300 Nm, an articulation angle of constant 10° and a speed of rotation of 1000 $min^{-1}$. During the experiment, the joints were air-cooled (rate of blowing on: about 12 m/s) and as failure there was evaluated the appearance of metal particles in the grease.

In the carrying out of this experiment, 31 joints were tested with a lubricating grease according to the present invention and 10 joints with the said high temperature grease "A" based on PU in serial use.

An evaluation of the working life individual values by means of Weibull distribution gave, for the grease according to the present invention, a distinctly improved working life, recognisable by the higher B10 and B50 values:

TABLE 2 of results

| | grease formulation according to the present invention | comparative grease |
|---|---|---|
| number of test pieces | 31 | 10 |
| B10 ($10^6$ rotations) | 13.8 | 9.7 |
| B50 ($10^6$ rotations) | 20.5 | 13.5 |

In FIG. 2 of the accompanying drawings is illustrated the graphic evaluation of the experiment. It can be seen that, with the grease according to the present invention, there was achieved a significantly higher number of rotations than with the comparative grease.

Experiment 3

For the assessment of the efficiency of the formulation according to the present invention with temperature stressing, there was carried out a working life failure test on ball homokinetic joints of the constructional type VL of the constructional size 107 (Löhr & Bromkamp, Offenbach, Federal Republic of Germany) with a dynamic transmission ability of 522 Nm and ball races made before the hardening. (see Schmelz, v. supra).

The test programme was a block programme with torques, speeds of rotation, articulation angles and running time parts according to the following Table. The listed programme steps were repeated until failure of the joints. During the running, the test joints were incorporated into heating boxes. In programme steps 7 to 12, the temperature in these boxes was so increased that the joint outer temperature was about 120° C. It is shown that the desired temperature level was achieved at a heating box inner temperature of 70°–80° C.

As failure, there was evaluated an overproportional temperature increase or the appearance of noises indicating wear.

TABLE 2

Block test programme

| step | rotational speed [$min^{-1}$] | torque [Nm] | number of rotations at angle 4.5° | 5.5° | 6.5° | 7.5° | 8.5° | 10° |
|---|---|---|---|---|---|---|---|---|
| 1 | 1260 | 108 | 5510 | 4910 | 3070 | 2430 | 1600 | 1620 |
| 2 | 669 | 540 | 2930 | 1390 | 950 | 940 | 770 | 1660 |
| 3 | 1260 | 140 | 3160 | 1830 | 1110 | 1070 | 780 | 620 |
| 4 | 1260 | 252 | 2000 | 1130 | 780 | 750 | 830 | 1300 |
| 5 | 1113 | 324 | 6480 | 3150 | 0 | 0 | 1170 | 1200 |
| 6 | 1113 | 324 | 4200 | 3200 | 3420 | 1930 | 0 | 0 |
| 7 | 910 | 396 | 6300 | 3500 | 2800 | 0 | 0 | 1400 |
| 8 | 910 | 396 | 7000 | 1400 | 0 | 3840 | 0 | 1850 |
| 9 | 910 | 396 | 6220 | 3150 | 1800 | 0 | 2690 | 0 |
| 10 | 770 | 468 | 4200 | 0 | 1400 | 1400 | 1400 | 0 |
| 11 | 770 | 468 | 4200 | 2040 | 0 | 1090 | 0 | 1780 |
| 12 | 770 | 468 | 1950 | 2100 | 1830 | 0 | 1080 | 2100 |
| 13 | 1260 | 90 | 3380 | 2860 | 2550 | 2510 | 2160 | 1380 |
| 14 | 590 | 612 | 1420 | 900 | 2510 | 860 | 400 | 3350 |

In the carrying out of this experiment, 7 joints were tested with a lubricating grease according to the present invention and 6 joints with the said high temperature grease "A" based on PU present in serial use.

An evaluation of the working life individual values by means of Weibull distribution have a distinctly improved working life for the grease according to the present invention, recognisable by the higher B10 and B50 values. The results obtained are given in the following Table:

TABLE 3 of results

| | grease formulation according to the present invention | comparative grease |
|---|---|---|
| number of test pieces | 7 | 6 |
| B10 (hours) | 541 | 241 |
| B50 (hours) | 1039 | 383 |

In FIG. 3 of the accompanying drawings is illustrated the graphic evaluation of this experiment. It can be seen that, with the grease according to the present invention, there was achieved a substantially higher running time than with the comparative grease.

Experiment 4

This experiment, which was analogous to experiment 2, was here extended to two further comparative comparative greases. The ball homokinetic joints and the experimental conditions were the same as those there described.

22 joints were tested with high temperature grease "A", 4 joints with a further commercially available high temperature grease "B" and 16 joints with a third commercially available high temperature grease "C".

Grease "B" consists of a base oil, a urea compound, molybdenum disulphide, molybdenum dithiocarbamate and lead dithiocarbamate. It does not contain graphite or polytetrafluoroethylene. Grease "C" consists of a base oil, a urea compound, molybdenum disulphide and graphite. It does not contain an organo-molybdenum compound or polytetrafluoroethylene.

An evaluation of the working life individual values by means of Weibull distribution gave, in comparison with the values already known from experiment 2, lower periods of life with the comparative greases, referred to the B50 values.

TABLE 4 of results

| | number of test pieces | B50 ($10^6$ rotations) |
|---|---|---|
| grease formulation according to the present invention | 31 | 20.5 |
| comparative grease "A" | 22 | 12.5 |
| comparative grease "B" | 4 | 13.0 |
| comparative grease "C" | 3.6 | 10.2 |

In FIG. 4 of the accompanying drawings is given the graphic evaluation supplemented by the numbered B10 values. The grease according to the present invention (on the left) is compared with the three comparative greases "A", "B" and "C". The higher number of rotations (by about factor 2) for the grease according to the present invention can be seen.

We claim:

1. A lubricating grease suitable for high temperature use, consisting essentially of:

60 to 90% by weight of a base oil mixture comprising at least one mineral oil and at least one synthetic oil, 5 to 17% by weight of at least one urea compound as a thickener, wherein the at least one urea compound is a reaction product of at least one fatty amine and at least one isocyanate or at least one diisocyanate, 2 to 20% by weight of calcium complex grease, 1 to 4% by weight of molybdenum disulphide, 0.2 to 1% by weight of graphite powder, 0.2 to 1% by weight of polytetrafluoroethylene powder, 0.2 to 1% by weight of solid particles of at least one organo-molybdenum compound selected from a molybdenum dithiocarbamate and a molybdenum dithiophosphate, up to 2% by weight of a metal deactivator and up to 2% by weight of a corrosion inhibitor.

2. The lubricating grease according to claim 1, wherein the said base oil mixture comprises 60 to 70% by weight of a naphthene-based mineral oil and 10 to 20% by weight of synthetic oil based on poly-α-olefins.

3. The lubricating grease according to claim 1, wherein the metal deactivator is a mercapto compound.

4. A lubricating grease according to claim 3, wherein the mercapto compound is a mercaptothiadiazole.

5. A lubricating grease according to claim 1, wherein the at least one organo molybdenum compound is molybdenum oxysulphide dithiocarbamate.

6. The lubricating grease according to claim 1, wherein the at least one organo-molybdenum compound is molybdenum dithiocarbamate, and the molybdenum dithiocarbamate is present at 0.2 to 0.6% by weight.

7. The lubricating grease according to claim 6, wherein the molybdenum dithiocarbamate has an average particle size of 0.5 to 20 micrometers.

8. The lubricating grease according to claim 1, wherein the at least one fatty amine is a primary fatty amine with a chain length of 8 to 22 carbon atoms.

9. The lubricating grease according to claim 14, wherein the at least one urea compound is a reaction product of at least one fatty amine and at least one diisocyanate, and the at least one diisocyanate is selected from the group consisting of 1,3-diisocyanatobenzene, 2,4-diisocyanatotoluene and 4,4'-diisocyanatodiphenylmethane.

10. A lubricating grease according to claim 9, wherein the at least one diisocyanate is 4,4'-diisocyanatediphenylmethane.

11. The lubricating grease according to claim 1, wherein the at least one urea compound is present at 5 to 12% by weight.

12. The lubricating grease according to claim 1, wherein the calcium complex grease is present at 2 to 8% by weight.

13. The lubricating grease according to claim 1, wherein the molybdenum disulfide is present at 1 to 3% by weight, and has a particle size of 0.2 to 10 micrometers.

14. The lubricating grease according to claim 1, wherein the graphite powder is present at 0.2 to 0.6% by weight, and has an average particle size of 0.1 to 10 micrometers.

15. The lubricating grease according to claim 1, wherein the polytetrafluoroethylene powder is present at 0.2 to 0.6% by weight, and has an average particle size of 1 to 20 micrometers.

16. The lubricating grease according to claim 1, wherein the corrosion inhibitor is present at 0.1 to 1% by weight.

17. A lubricating grease suitable for high temperature use, consisting essentially of:

60 to 70% by weight of at least one mineral oil, 10 to 20% by weight of at least one synthetic oil based on poly-α-olefins, 5 to 12% by weight of at least one urea compound as a thickener, wherein the at least one urea compound is a reaction product of at least one fatty amine and at least one isocyanate or at least one diisocyanate, 2 to 8% by weight of calcium complex grease, 1 to 3% by weight of molybdenum disulphide having a particle size of 0.2 to 10 μm, 0.2 to 0.6% by weight of graphite powder having an average particle size of 0.1 to 10 μm, 0.2 to 0.6% by weight of polytetrafluoroethylene powder having an average particle size of 1 to 20 μm, 0.2 to 0.6% by weight of solid particles of molybdenum dithiocarbamate having an average particle size of 0.5 to 20 μm, 0.3 to 1% by weight of mercaptothiadiazole and 0.1 to 1% by weight of a corrosion inhibitor.

* * * * *